US010927867B2

(12) United States Patent
Meitinger et al.

(10) Patent No.: US 10,927,867 B2
(45) Date of Patent: Feb. 23, 2021

(54) WORK MACHINE HAVING HYDRAULICS FOR ENERGY RECOVERY

(71) Applicant: Liebherr-Hydraulikbagger GmbH, Kirchdorf/Iller (DE)

(72) Inventors: Bernhard Meitinger, Buxheim (DE); Manuel Wirthensohn, Oberstdorf (DE)

(73) Assignee: LIEBHERR-HYDRAULIKBAGGER GMBH, Kirchdorf/Iller (DE)

( * ) Notice: Subject to any disclaimer, the term of this patent is extended or adjusted under 35 U.S.C. 154(b) by 0 days.

(21) Appl. No.: 16/259,128

(22) Filed: Jan. 28, 2019

(65) Prior Publication Data

US 2019/0234049 A1 Aug. 1, 2019

(30) Foreign Application Priority Data

Jan. 29, 2018 (DE) ..... 10 2018 101 924.6

(51) Int. Cl.
*F15B 21/14* (2006.01)

(52) U.S. Cl.
CPC ..... *F15B 21/14* (2013.01); *F15B 2211/20569* (2013.01)

(58) Field of Classification Search
CPC ..... F15B 21/14; F15B 2211/20569; F15B 2211/88
See application file for complete search history.

(56) References Cited

U.S. PATENT DOCUMENTS 9,194,107 B2 * 11/2015 Andruch, III ..... E02F 9/2217
10,161,423 B2 * 12/2018 Rampen ..... F15B 11/0445
2016/0245311 A1 * 8/2016 Kajita ..... E02F 9/2217

FOREIGN PATENT DOCUMENTS

EP 2722530 A1 4/2014

* cited by examiner

*Primary Examiner* — F Daniel Lopez
(74) *Attorney, Agent, or Firm* — McCoy Russell LLP

(57) ABSTRACT

The present invention relates to a work machine having at least one hydraulic actuator for actuating a piece of working equipment and having a first displacement unit that is driven by a drive assembly of the work machine and that feeds the hydraulic actuator with hydraulic medium from a hydraulic tank, wherein at least one second displacement unit is provided that is driven by the drive assembly and that feeds the hydraulic actuator and/or further hydraulic consumers with hydraulic medium from a hydraulic tank in the working mode and that is drivable during a recovery mode by the hydraulic volume displaced by the at least one hydraulic actuator or by a hydraulic consumer to feed kinetic energy back to the drive assembly.

10 Claims, 7 Drawing Sheets

WORK MACHINE HAVING HYDRAULICS FOR ENERGY RECOVERY

CROSS-REFERENCE TO RELATED APPLICATIONS

The present application claims priority to German Application No. 10 2018 101 924.6 entitled "WORK MACHINE HAVING HYDRAULICS FOR ENERGY RECOVERY," filed Jan. 29, 2018. The entire contents of the above-listed application are hereby incorporated by reference in their entirety for all purposes.

TECHNICAL FIELD

The invention relates to a work machine having at least one hydraulic actuator for actuating a piece of working equipment and having a first displacement unit that is driven by a drive assembly of the work machine and that feeds the hydraulic actuator with hydraulic medium from a hydraulic tank.

BACKGROUND AND SUMMARY

An example for a corresponding work machine is a hydraulic excavator whose boom arm can be actuated by means of a hydraulic linear actuator such as a piston-in-cylinder unit. Hydraulic energy typically does not have to be applied for the lowering of the boom since the boom can lower due to the load. It is desirable in this connection to feed the potential energy that is released in this process back into the system.

Various solution approaches are known for energy recovery from the prior art to date. Some of these solution approaches are based on a closed hydraulic circuit for the energy recovery; however, this is comparatively expensive and complex. In accordance with alternative solutions, a displacer is conveyed with the fed back hydraulic medium on a lowering movement. The torque thereby generated drives a connected generator to generate electrical energy. The electrics required for this also make this solution comparatively complex and expensive, in particular since the recovered energy first has to be buffered.

An alternative solution is therefore sought that is comparatively simple.

This object is achieved by a work machine having at least one hydraulic actuator for actuating a piece of working equipment and having a first displacement unit that is driven by a drive assembly of the work machine and that feeds the hydraulic actuator with hydraulic medium from a hydraulic tank, characterized in that at least one second displacement unit is provided that is driven by the drive assembly and that feeds the hydraulic actuator and/or further hydraulic consumers with hydraulic medium from the hydraulic tank in a working mode and that is drivable during a recovery mode by a hydraulic volume displaced by the at least one hydraulic actuator or by a hydraulic consumer to feed kinetic energy back to the drive assembly.

In accordance with the invention, a work machine of the category is accordingly expanded by at least one second displacement unit that is driven by the drive assembly and that feeds the hydraulic actuator and/or further separate hydraulic consumers with hydraulic medium from a hydraulic tank in a working mode. During a recovery mode, the second displacement unit is driven by the hydraulic medium displaced by the at least one actuator or by a further hydraulic consumer. The kinetic energy hereby generated is fed back to the drive assembly via the drive shaft, whereby the drive assembly is relieved during the recovery mode.

The additional second displacement unit accordingly serves not only for the energy recovery, but also acts as an additional work pump in the regular working mode, said work pump either assisting the first displacement unit or alternatively supplying separate consumers with energy.

It is characteristic for the solution in accordance with the invention that both the first displacement unit and the second displacement unit are parts of an open hydraulic circuit, i.e. the hydraulic actuator is supplied with energy via an open hydraulic circuit. The implementation of the solution in accordance with the invention thereby becomes a lot simpler in comparison with existing solutions of the prior art.

In accordance with an advantageous embodiment of the invention, a control block is provided via which the outgoing pressure lines of the first and second displacement units are connectable to the hydraulic actuator and optionally to further consumers. A corresponding control block comprises at least one control slide valve for the hydraulic actuator and further control slide valves for additional optional consumers. A corresponding control slide valve can provide a plurality of switching states, for example one respective switch position per direction of movement of the actuator and optionally a neutral position for the separation of the pressure line from the actuator input. The same applies to the at least one further control slide valve for optional consumers.

In accordance with an example embodiment, at least one first valve, in particular a ski selector valve or directional control valve, having at least two switch positions is provided that is arranged between the second displacement unit and the control block. The connection between the second displacement unit and the control block can be released or interrupted via the at least two switch positions. A first switch position is accordingly provided that releases a volume flow from the second displacement unit to the control block, while a second switch position interrupts a volume flow between the second displacement unit and the control block.

In addition, at least one second valve, in particular a ski selector valve or directional control valve, can be provided that connects or interrupts a direct connection between the at least one hydraulic actuator and the second displacement unit. The second ski selector valve is in particular connected to the output of the hydraulic actuator at which a corresponding volume flow can be generated on the lowering caused by a load for the energy recovery. This can be, for example, the bottom-side connection with a piston-in-cylinder unit. The second ski selector valve may comprise at least two switch positions, with a first switch position switching a volume flow from the hydraulic actuator to the second displacement unit, while the second switch position blocks a volume flow from the actuator to the second displacement unit.

It is furthermore expedient if at least one machine control of the work machine is provided that correspondingly controls the first and second ski selector valves for the recovery mode or for the regular working mode. The corresponding control can take place in dependence on the position of an operating lever provided for the actuator actuation. This machine control can be configured as a separate machine control; however, its integration in a machine control anyway provided is suitable.

In a further example, the first ski selector valve is brought into its blocked position by the machine control for the recovery mode, while the second ski selector valve is switched into its flow position. The valves are in particular accordingly switched by the machine control when the operating lever is brought into a position for a load-induced lowering. In this state, the volume flow generated by the lowering of the actuator can feed the second displacement unit working as a hydraulic motor via the second ski selector valve.

For the regular working mode, as soon as a movement contrary to the load-induced lowering movement is triggered by means of the operating lever, the machine control switches the first ski selector valve into its flow position while the second ski selector valve remains in its blocked position. The second displacement unit working as a hydraulic pump in this case sucks in hydraulic medium from the tank and feeds the volume flow via the first ski selector valve into the pressure line of the work circuit or into the pressure line of the control block. The same can also apply to a neutral position of the operating lever.

The at least one hydraulic actuator may be a piston-in-cylinder unit that serves the actuation of a boom of the work machine. On the lowering of the boom, the work machine accordingly switches into recovery mode so that the emitted potential energy can be fed back into the total system by means of the second displacement unit. It is, however, likewise conceivable if at least one hydraulic actuator is a rotary consumer, for example a hydraulic travel drive of the work machine.

The second displacement unit can be an adjustable pump motor. An electrically regulated pump having a check valve in the suction is also conceivable. The latter would make the use of the aforesaid first ski selector valve between the displacement pump and the control block unnecessary.

Provision is made on a use of the adjustable hydraulic motor or of the electrically regulated pump that the machine control of the work machine sets the pivot angle of the adjustable hydraulic motor or of the electrically regulated pump in the recovery mode in dependence on a wanted desired movement speed of the hydraulic actuator, in particular of the piston-in-cylinder unit, i.e. in dependence on the desired lowering speed of the hydraulic actuator, for example, of the boom arm. In one example, the desired lowering speed can be determined using the actual position of an operating lever for actuating the actuator. The machine control is accordingly connected to the operating lever for determining its actual position. The maximum volume flow caused by the actuator in recovery mode can be set via the set pivot angle.

If the hydraulic actuator is a rotary drive and if the recovery takes place in the braking mode of the rotary drive, the pivot angle can take place in dependence on the transducer position of a transducer for controlling the rotary drive and/or in dependence on the speed of the rotary drive detected by a sensor.

In one example, at least one further hydraulic consumer can be supplied with hydraulic energy by the first displacement unit during the recovery mode. Only the second displacement unit works in motor mode; the regular working mode of the first displacement unit remains unaffected by this.

Provision can be made that a restrictor, in particular a variable aperture restrictor, such as in the form of a proportional ski selector valve having an open end position and a blocking end position, is additionally introduced between the second ski selector valve and the second displacement unit. The triggered speed of the second displacement unit can be controlled via the degree of opening of the restrictor by restricting the volume flow generated by the actuator. A speed increase of the drive assembly should hereby in particular be reduced or stopped by the emitted kinetic energy of the second displacement unit.

It is furthermore possible to arrange at least one proportionally controllable bypass valve at the outlet of the second ski selector valve, with the degree of opening of said bypass valve being increased by the machine control if the desired movement speed of the actuator cannot be reached in the recovery mode due to the volume flow restriction of the second displacement unit, i.e. the required volume flow at the outlet of the actuator would exceed the maximum possible volume flow of the second displacement unit. The excess volume flow can be conducted via the bypass into the hydraulic tank with the aid of the bypass valve so that a reaching of the desired movement speed of the actuator is ensured.

BRIEF DESCRIPTION OF THE DRAWINGS

Further advantages and properties of the invention will be explained in more detail with reference to an embodiment shown in the Figures. There are shown.

DETAILED DESCRIPTION

Figure 1:
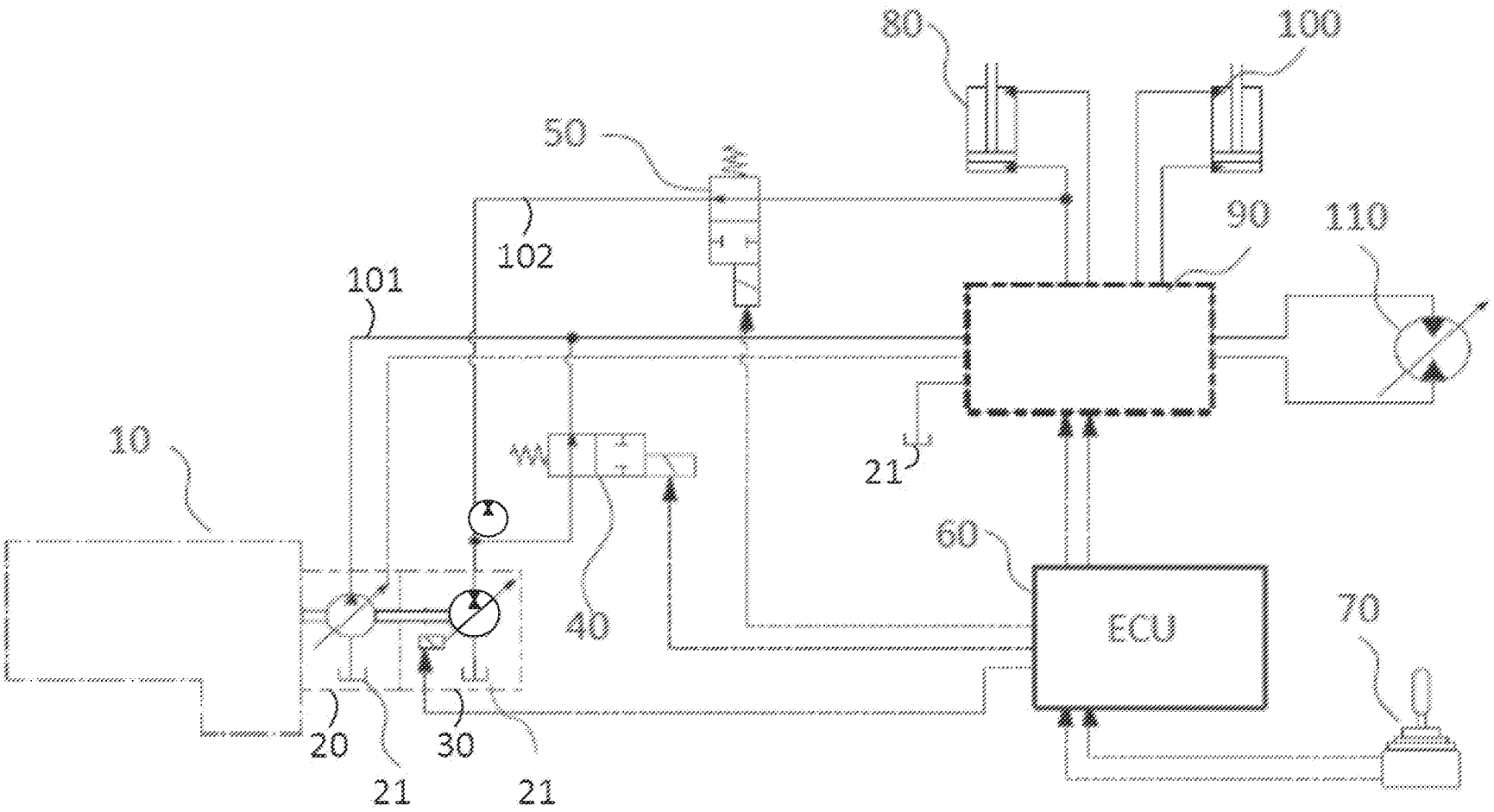
FIG. 1: a hydraulic circuit diagram to illustrate the operation in accordance with the invention of the work machine in the form of a hydraulic excavator.

The basic operation of the present invention will be explained with reference to the outlined hydraulic circuit diagram of FIG. 1. Here, the control block 90 for the control of the hydraulic actuator 80 is not shown further, but the key idea of the invention should rather be independently explained with reference to the circuit diagram.

A linear actuator can be seen here in the form of a piston-in-cylinder unit 80 that serves the actuation of the excavator boom of the work machine in accordance with the invention. The required hydraulic pressure is provided by the main pump 20 that is driven via the central drive assembly 10. The pump 20 is designed as a variable delivery pump. The hydraulic circuit is configured as an open hydraulic circuit since the hydraulic pump 20 sucks in the required hydraulic medium from a tank 21 coupled to the pump 20 and supplies the linear actuator 80 with hydraulic energy via the control block 90. The feed pressure can be selectively supplied to the connection of the actuator at the bottom side or at the rod side via the block 90 to control the actuation direction of the piston.

In accordance with the invention, a second displacement unit 30 is installed that is driven via the same output shaft of the drive assembly 10 together with the first displacement unit 20 by the drive assembly 10. This second displacement unit is designed as an adjustable pump motor whose pivot angle is set by the central machine control 60. The second displacement unit 30 is, on the one hand, also connected to the hydraulic tank 21 and provides a corresponding volume flow at its outlet in the regular working mode in dependence on the set pivot angle. This pressure line is connected to the control block 90 via a first ski selector valve 40, with the outlet of the ski selector valve 40 being combined with the pressure outlet line 101 of the main pump 20.

The first ski selector valve 40 comprises two switch positions. In the first switch position, the valve is open in the direction of the control block 90 so that the outlet pressure of the hydraulic motor of the second displacement pump 30 together with the pressure line 101 of the main pump 20 is applied at the pressure inlet of the control block 90. The valve blocks in the second switch position. The switch position of the ski selector valve is actuated by the control 60.

The second displacement unit 30 is furthermore connected to the linear actuator 80 by means of a second ski selector valve 50 via the same connection along another pressure line 102. In the embodiment shown, the valve inlet is connected to the bottom-side connection of the linear actuator since a volume flow is generated there by hydraulic oil exiting at the bottom side in the recovery mode, i.e. on the lowering of the excavator arm.

The valve 50 likewise comprises two switch positions of which one releases the flow from the actuator 80 to the hydraulic motor of second displacement unit 30 and of which the second blocks the flow. This second ski selector valve 50 is also controlled via the central control unit 60.

Further hydraulic consumers 100, 110 can be supplied with the required pressure level by the pumps 20, 30 via the control block 90. The actuator 80 is operated via operating lever 70, which may be configured as a transducer.

The position of the operating lever is recognized by the control. In the neutral position of the operating lever 70 or in its position for raising the boom (called the working mode in the following), the control 60 ensures that the ski selector valve 40 remains in its feed-through position and the ski selector valve 50 remains in the blocked position. The displacement unit 30 in this case works as an additional work pump and the generated volume flow is provided at the pressure inlet of the control block 90 via the valve 40. The bottom-side connection of the actuator is only connected to the control block 90 due to the blocked position of the valve 50. In addition to the actuator 80, further consumers 100, 110 can be supplied with oil by the work pumps 20, 30.

If the operating lever 70 is brought into the corresponding position for lowering the excavator boom, this is recognized by the control 60 and the hydraulics are switched to the recovery mode. For this purpose, the valve 40 is switched into its blocked position by the control 60, whereby the volume flow from the second displacement unit 30 to the control block 90 is interrupted. At the same time, the control 60 switches the second ski selector valve 50 into its flow position and the pivot angle of the hydraulic motor 30 is set to a negative pivot angle. The hydraulic pressure of the bottom side of the actuator 80 can hereby be output via the ski selector valve 50 to the second displacement unit 30 working as a motor, whereby it generates a torque that relieves the drive shaft of the drive motor of central assembly 10.

The specific pivot angle of the pump motor 30 is fixed by the control 60 in dependence on the actual deflection of the operating lever 70 since the latter is ultimately decisive for the achievable lowering speed of the boom arm. The further consumers 100, 110 can still be supplied with hydraulic oil by the work pump 20 in the recovery mode.

Figure 2:
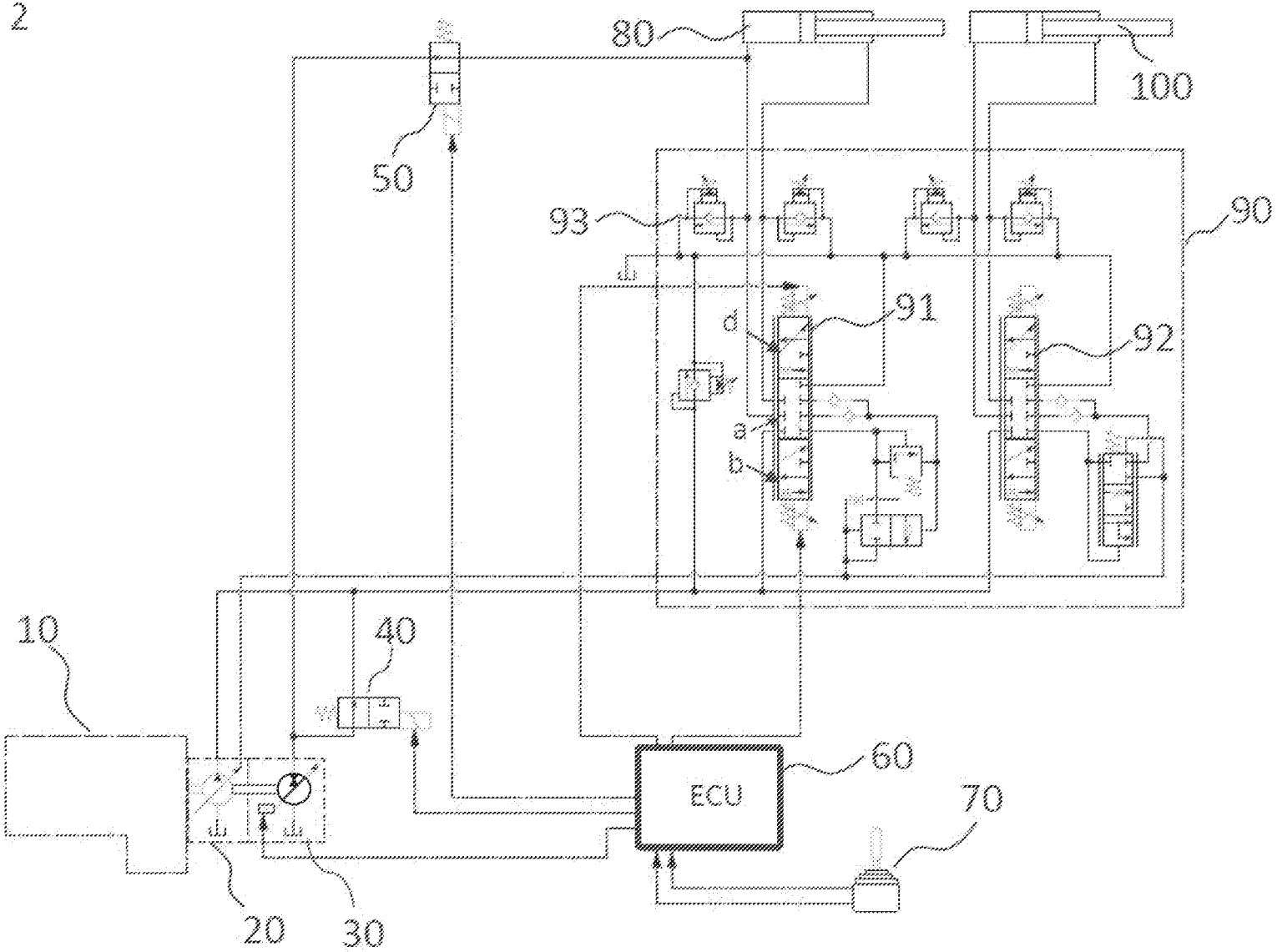
FIG. 2: a hydraulic circuit diagram for a first embodiment of the present invention.

FIG. 2 shows details of the control block 90 for the control of the actuator 80 as well as further consumers 100 in accordance with a first embodiment. The other components correspond to the design of FIG. 1. The common pressure line of the displacement units 20, 30 is connected to a first control slide valve 91 in the form of a proportional ski selector valve. It comprises a total of three switch positions a, b, and d. a marks the neutral position in which the valve blocks completely. In switch position b, the common pressure line of the displacement units 20, 30 is connected to the bottom side of the actuator 80; the extending piston rod consequently produces a raising of the boom. In switch position d, the common pressure line is in contrast connected to the rod side of the actuator 80; the volume flow provided by the displacement units 20, 30 actively presses the piston into the cylinder unit and the boom is "actively" lowered.

The valve 40 is brought into its blocked position for the recovery mode so that no oil can flow from the displacement unit 30 to the control slide valve 91. The control slide valve 91 remains in neutral position a and the valve 50 is opened.

The displacement unit 30 is set to a specific negative pivot angle in dependence on the deflection of the operating lever 70 that presets the lowering speed. The equipment thereby lowers at the desired speed. During the lowering procedure, oil that is provided from the tank 21 via an anti-cavitation valve 93 of the control block 90 is required on the rod side of the cylinder 80. The displacement unit 30 generates a torque that is determined by the pressure that is present in the cylinder bottom of the actuator 80 and generates the set pivot angle of the displacement unit 30. The drive assembly 10 is relieved by this torque.

As soon as pressure is required on the rod side to maintain the lowering movement, it is necessary to switch over into the mode "active lowering". For this purpose, the valve 40 is switched into its flow position while the valve 50 moves into a blocked position. Oil can now flow from the displacement unit 30 to the control slide valve 91 that is in position 91*d*. The control slide valve 91 has to further convey oil from the pumps 20, 30 to the rod side of the lifting cylinder 80. The oil from the bottom side has to flow back to the tank via the control slide valve 91; the valve 50 remains blocked. The displacement unit 30 in this operating state acts as a second work pump or as a pump for further consumers 100.

The valve 40 is opened for the regular working mode, i.e. for raising the boom; oil can flow from the displacement unit 30 to the control slide valve 91. The valve 50 remains closed. The displacement unit 30 is a second work pump or a pump for further consumers 100 in this operating state.

The control of the further consumer in the form of a second piston-in-cylinder unit 100 is implemented in a similar manner by means of a second control slide valve 92 of the same construction and by means of additional anti-cavitation valves.

Figure 3:
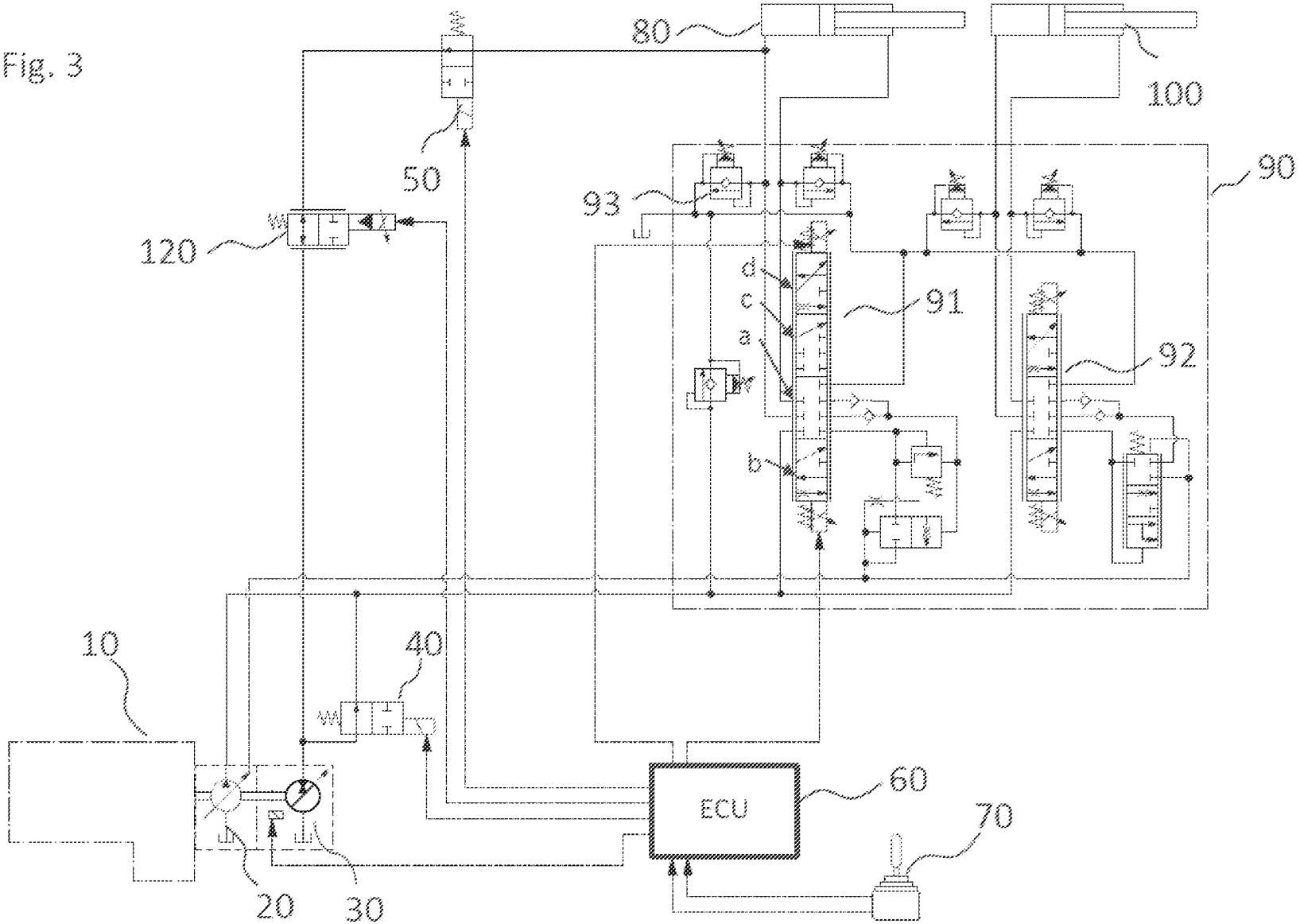
FIG. 3: a further hydraulic circuit diagram for a second embodiment.

A modified embodiment of the hydraulics can be seen from FIG. 3. The same elements are provided with identical reference numerals. In contrast to the embodiment variant of FIG. 2, a variable aperture restrictor 120 is additionally inserted downstream after the second ski selector valve 50, i.e. between the valve 50 and the second displacement unit 30. The variable aperture restrictor 120, configured as a proportionally controllable ski selector valve 120, adopts a degree of opening between an end position with a full bidirectional flow and a second end position in which the valve 120 blocks completely. The volume flow between the ski selector valve 50 and the displacement unit 30 can thereby be restricted to a specific volume flow. The current degree of opening of the restrictor 120 is likewise set by the control 60. It should, for example, be prevented via the restrictor 120 that the motor 10 is accelerated by the output torque of the displacement unit 30. A reduction of the volume flow is required for this purpose, which is achieved by the corresponding reduction of the cross-section in the valve 120.

As a further change with respect to FIG. 2, the control slide valve 91 of the control block 90 of FIG. 3 comprises an additional switch position 91*c*. If the volume flow is greater than the possible volume flow via the displacement unit 30 due to the required desired speed of the actuator 80, the control slide valve 91 is switched into the position 91*c*.

Figure 4:
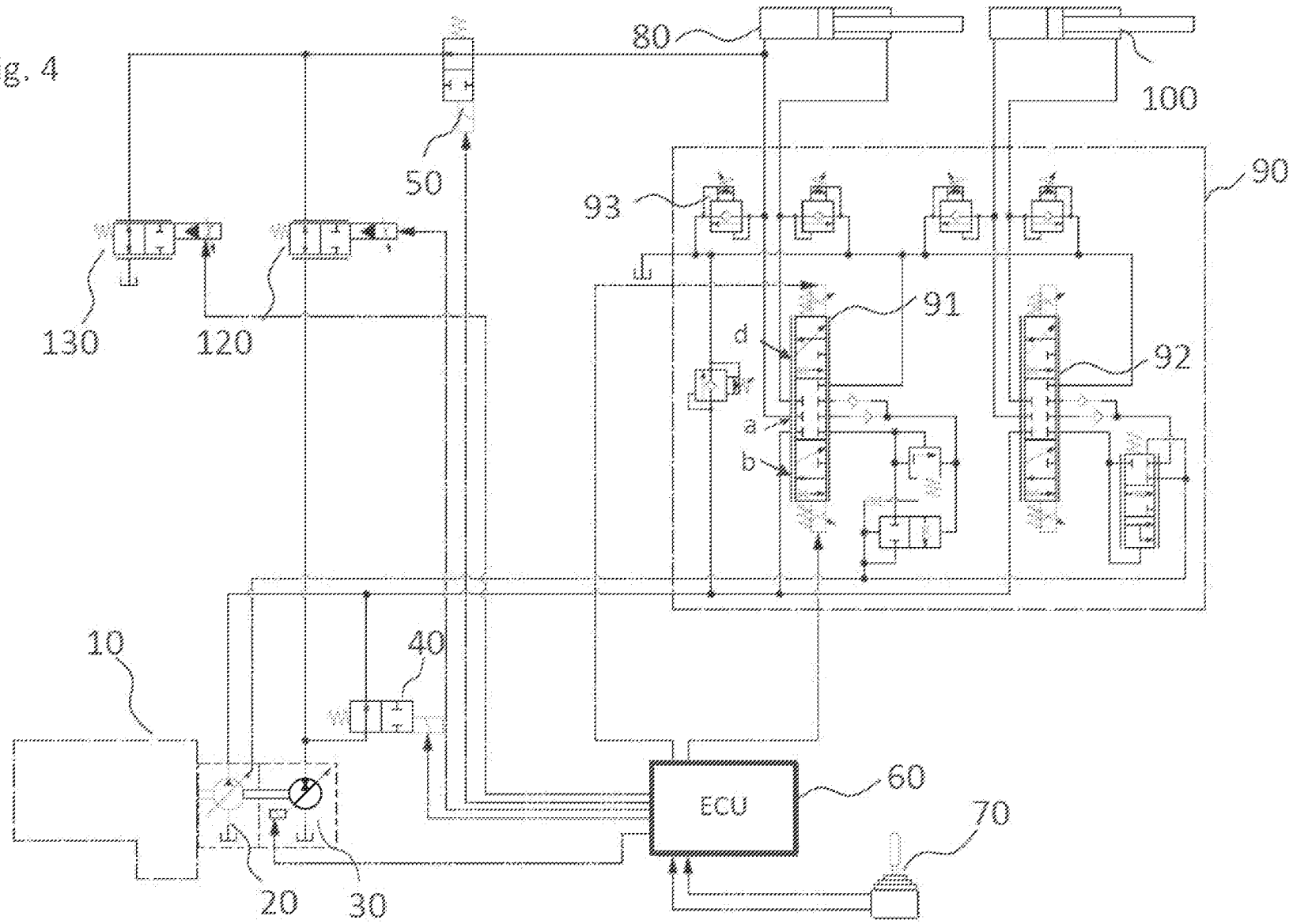
FIG. 4: a further hydraulic circuit diagram for a third embodiment.

Alternatively to the modification of the control slide valve 91 with the additional switch position 91*c*, an additional bypass valve 130 can be arranged downstream at the ski selector valve 50, as is shown in FIG. 4. In dependence on its degree of opening, this proportionally controllable ski selector valve 130 switches a bypass of the volume flow into the hydraulic tank generated in the recovery mode. If the volume flow is greater than the maximum possible volume flow of the displacement unit 30 due to the required desired speed of the actuator 80, the bypass valve 130 is opened so much that the required lowering speed can be reached.

The presented embodiments of the hydraulic circuits of FIGS. 1 to 4 cannot only be used for the energy recovery in linear drives, but the presented functional principle can likewise be used in rotary drives. This is shown for the example of FIG. 5. The hydraulic design substantially corresponds to the hydraulic circuit diagram of FIG. 4; the same elements and components were also marked in FIG. 5 by the same reference numerals as in FIGS. 1 to 4. Reference is therefore made to the preceding Figure description for the description in this respect.

Figure 5:
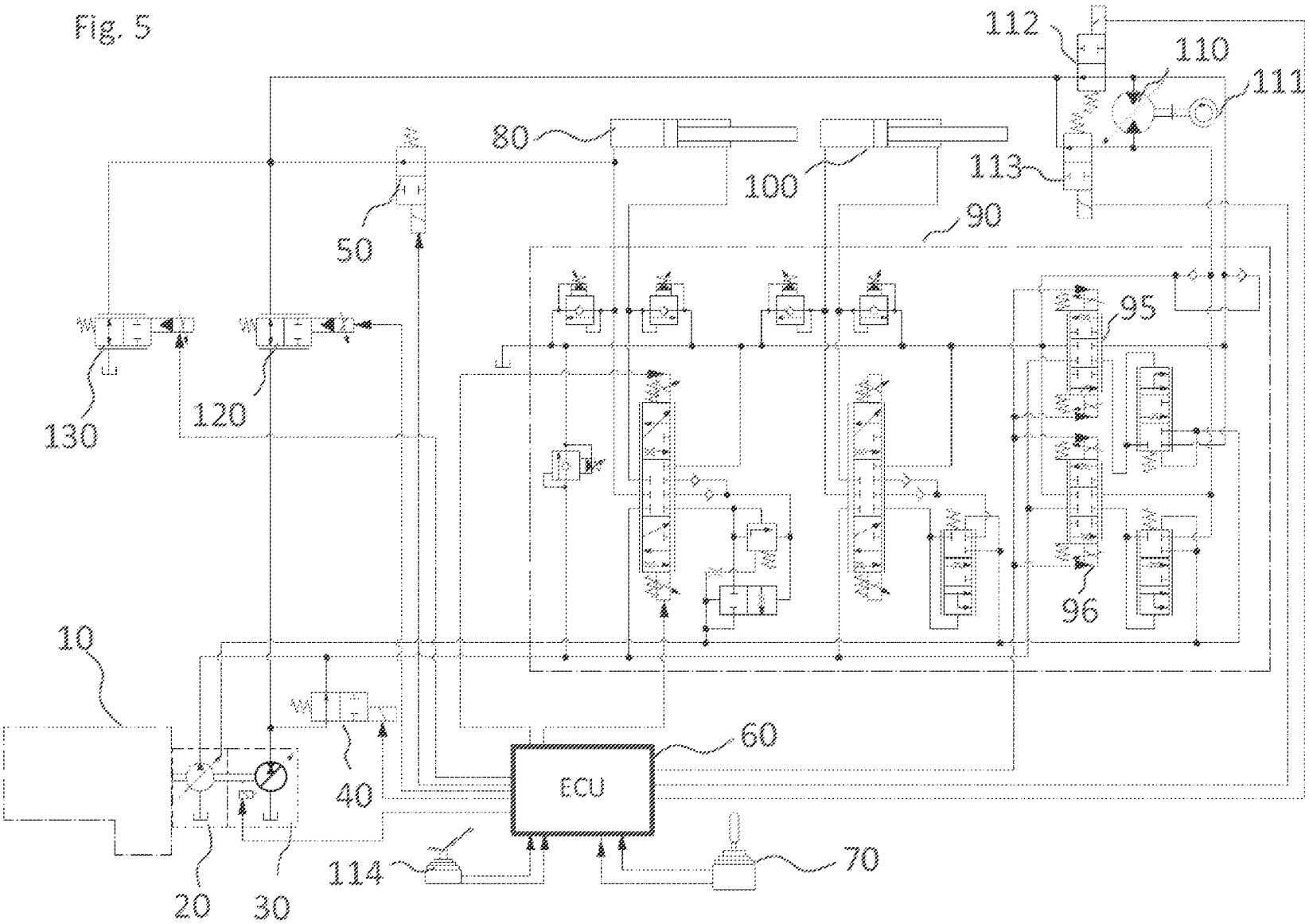
FIG. 5: a hydraulic circuit diagram of a modification of the third embodiment in accordance with FIG. 4.

Unlike FIG. 4, in FIG. 5 a rotary drive 110 is controlled by means of the control block in addition to the linear actuators. The rotary drive can, for example, be a travel drive of the work machine. For this purpose, it can inter alia be supplemented by the additional proportional control valves 95, 96 that provide the required hydraulic supply of the drive 110. Energy should also be recovered here on the braking of the rotary consumer 110 to output a torque to the internal combustion engine 10 by means of the displacement unit 30.

In the regular working mode of the consumer 110, the valve 40 is switched into the open position, whereby oil can flow from the displacement unit 30 to the control slide valve 90. The valve 50 has to be closed. The valves 95, 96 of the control block 90 release an opening cross-section in dependence on the position of the now provided transducer 114, whereby the required speed and/or rotational speed of the motor 110 can be set. In addition, the direction of rotation can be predefined by the switch position of the valves 95, 96. The rotational drive 110 can be accelerated or the current rotational speed can be maintained.

In the braking mode or recovery mode of the drive 110, the valve 40 is switched into the closed position; no oil can therefore flow from the displacement unit 30 to the control block 90. The valve 50 is opened. If the motor 110 turns clockwise, the valve 95 must be in the lower regulation position. The valve 96 is in the closed position. The additional ski selector valve 112 is in this case located on the outflow side of the motor 110 and must be in the open switch position, whereby the outflowing oil can be conducted into the tank via the displacement unit 30. The displacement unit 30 is set to a specific negative pivot angle that is predefined by the ECU 60. The ECU 60 calculates the value of the pivot angle from the drive speed that the sensor 111 predefines and from the detected position of the transducer 114.

The displacement unit 30 generates a torque that results from the generated hydraulic pressure of the drive 110 during the braking procedure and from the set pivot angle of the displacement unit 30 and outputs it to the internal combustion engine 10. The further consumers 80, 100 can in the meantime be supplied with oil from the work pump 20.

If only the drive 110 is controlled (e.g. travel drive with a mobile excavator on public roads), a regulation can take place in a similar manner to a closed circuit. The work pump 20 and one of the valves 95 or 96 (depending on the direction of travel) predefine the speed of the motor 110 in dependence on the transducer 114. Depending on the direction of travel, one of the valves 112, 113 that is on the outflow side of the motor 110 always has to be in the open position. The outflowing oil thus flows back via the valve 120 and via the displacement unit 30.

The operation of the valves 120 and 130 corresponds to the function that has already been explained with reference to the embodiment of FIG. 4. If the rotary consumer 110 should have a brake valve (not shown here), this naturally also has to be controllable by the ECU 60. The integration of the rotary drive could naturally also take place, with a corresponding expansion of the control block 90, in one of the embodiments in accordance with FIGS. 1 to 3.

The system for recovery described here (in particular the embodiments in accordance with FIGS. 1 to 5) cannot only be implementable for the LS system shown here, but also for systems having an electric pump regulation.

A mixed system of LS valves and separate control edge valves is shown in FIG. 5. If the hydraulic system is designed as a simple system having separate control edge valves (without pressure scales), an electric pump regulation may be necessary. The recovery is substantially simplified—as described here—by such a system since in the case of recovery the valve in the outflow can be closed and the valve in the inflow can only be opened as required.

Figure 6:
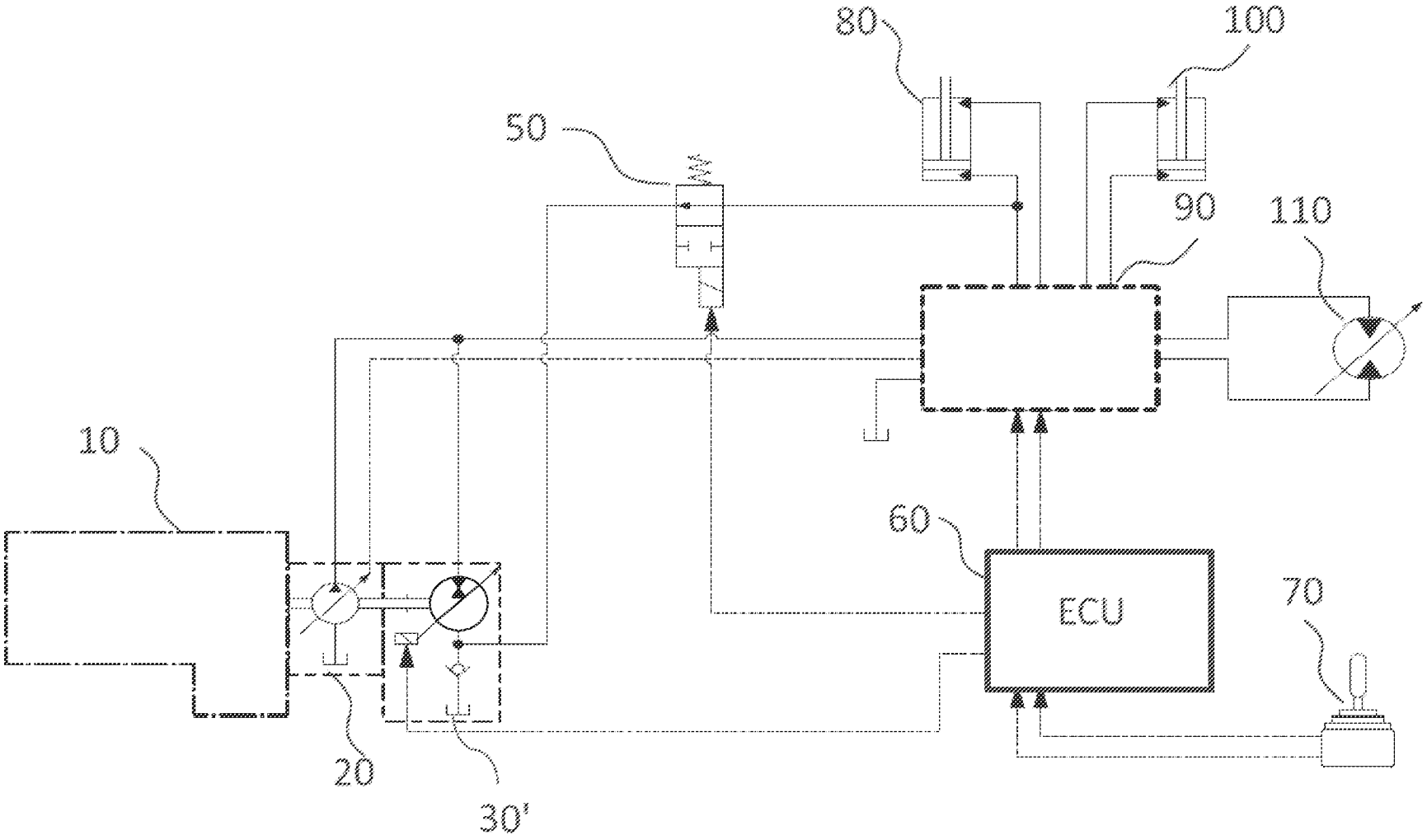
FIG. 6: a hydraulic circuit diagram to illustrate a modification of all the embodiments in accordance with FIGS. 1 to 5.
Figure 7:
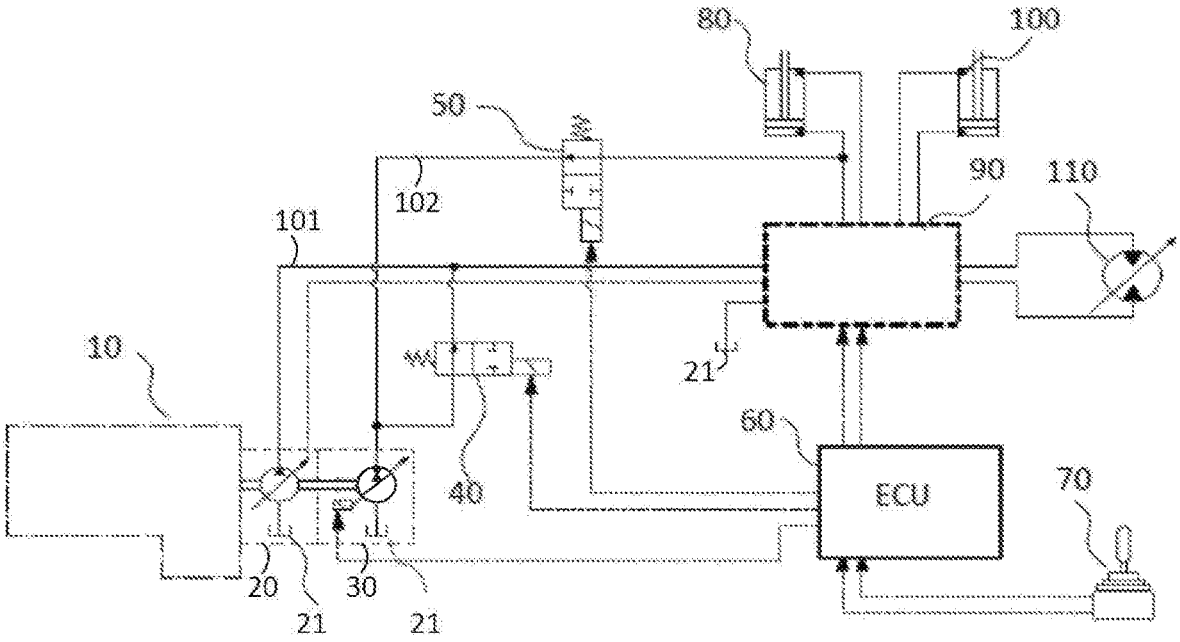
FIG. 7: a hydraulic circuit diagram to an embodiment including a pump motor.

Alternatively to FIG. 1 in which 30 is a pump motor, the displacement unit could also be designed in the form of an electrically regulated pump having a check valve in the suction, depicted at FIG. 6 as motor 30'. The valve 40 could thereby be dispensed with, which is in particular shown in FIG. 6. The valve 50 is then here also directly connected to the actual suction side of the pump 30' that acts as a pressure inlet in the recovery mode.

If large amounts of energy are fed back into the system, it is meaningful to install an energy storage device such as is described in EP 2 722 530 A1 whose content is referenced in full at this point and whose contents are incorporated by reference herein.

The invention claimed is:

1. A work machine comprising:

at least one hydraulic actuator for actuating a piece of working equipment, and a first displacement unit that is driven by a drive assembly of the work machine and that feeds the at least one hydraulic actuator with hydraulic medium from a hydraulic tank, wherein a second displacement unit is provided that is driven by the drive assembly and that feeds the at least one hydraulic actuator and/or further hydraulic consumers with hydraulic medium from the hydraulic tank in a working mode and that is drivable during a recovery mode by a hydraulic volume displaced by the at least one hydraulic actuator or by a hydraulic consumer to feed kinetic energy back to the drive assembly, a control block via which pressure lines of the first and second displacement units are connectable to the at least one hydraulic actuator and one or more of the further consumers, at least one first selector valve having at least two switch positions whose first switch position allows flow from the second displacement unit to the control block and whose second switch position interrupts a volume flow between the second displacement unit and the control block, and at least one second selector valve having at least two switch positions via which a direct connector between the at least one hydraulic actuator and the second displacement unit can be allowed or blocked, the direct connector including the volume flow from the at least one hydraulic actuator to the second displacement unit.

2. The work machine in accordance with claim 1, further comprising a machine control to control the first and second selector valves, the machine control switching the first selector valve into its blocked position and the second selector valve into its flow position in the recovery mode, and the machine control bringing the first selector valve into its flow position and the second selector valve into its blocked position in the working mode.

3. The work machine in accordance with claim 2, further comprising at least one variable aperture restrictor, including a proportional selector valve having an open position and a blocking end position, the restrictor arranged between the second selector valve and the second displacement unit, wherein a degree of opening of the restrictor is selected by the machine control so that kinetic energy fed back by the second displacement unit does not result in a speed increase of the drive assembly.

4. The work machine in accordance with claim 2, further comprising at least one proportionally controllable bypass valve provided at an output of the second selector valve, wherein a degree of opening of the bypass valve is increased by the machine control if the volume flow to be displaced due to a movement speed of the at least one actuator desired in the recovery mode is greater than a maximum possible volume flow for driving the second displacement unit.

5. The work machine in accordance with claim 1, wherein the second displacement unit is an adjustable pump motor or having a check valve in a suction of the pump.

6. The work machine in accordance with claim 5, wherein a machine control of the work machine sets a pivot angle of the adjustable pump motor or of the electrically regulated pump in the recovery mode in dependence on a desired movement speed of the at least one hydraulic actuator, including in dependence on one of an actual position of an operating lever for the at least one hydraulic actuator actuation and a detected rotary speed of the at least one hydraulic actuator.

7. The work machine in accordance with claim 1, wherein the at least one hydraulic actuator is a piston-in-cylinder unit that actuates a boom of the work machine, and wherein the recovery mode takes place during a lowering movement of the boom.

8. The work machine in accordance with claim 1, wherein at least one hydraulic actuator is a rotary drive and wherein the recovery mode takes place during a braking of rotational movement of the rotary drive.

9. The work machine in accordance with claim 1, wherein the further hydraulic consumers are supplied with hydraulic energy by the first displacement unit in the recovery mode.

10. The work machine in accordance with claim 1, wherein the work machine is a hydraulic excavator and the at least one hydraulic actuator is a piston-in-cylinder unit for actuating an excavator arm.

* * * * *